United States Patent [19]

Comeau

[11] 4,438,799

[45] Mar. 27, 1984

[54] TEAR STARTING MECHANISM FOR TEAR SHADES

[75] Inventor: Paul E. Comeau, Warwick, R.I.

[73] Assignee: Kenney Manufacturing Company, Warwick, R.I.

[21] Appl. No.: 370,595

[22] Filed: Apr. 21, 1982

[51] Int. Cl.[3] ..... A47G 5/02

[52] U.S. Cl. ..... 160/263

[58] Field of Search ..... 160/263, 250, 36, 86; 428/43, 132, 136

[56] References Cited

U.S. PATENT DOCUMENTS 4,102,383 7/1978 Miller ..... 160/263

*Primary Examiner*—Peter M. Caun

*Attorney, Agent, or Firm*—Robert B. Russell

[57] ABSTRACT

A shade of adjustable width is provided in which portions can be removed by tearing along score lines, and means including pull tabs are provided whereby a portion in the margin of the shade may be removed leaving a widened opening which terminates at an apex at a given score line such that pulling adjacent portions of the shade material concentrates stress at the score line and promotes clean tearing therealong.

6 Claims, 3 Drawing Figures

FIG. 1
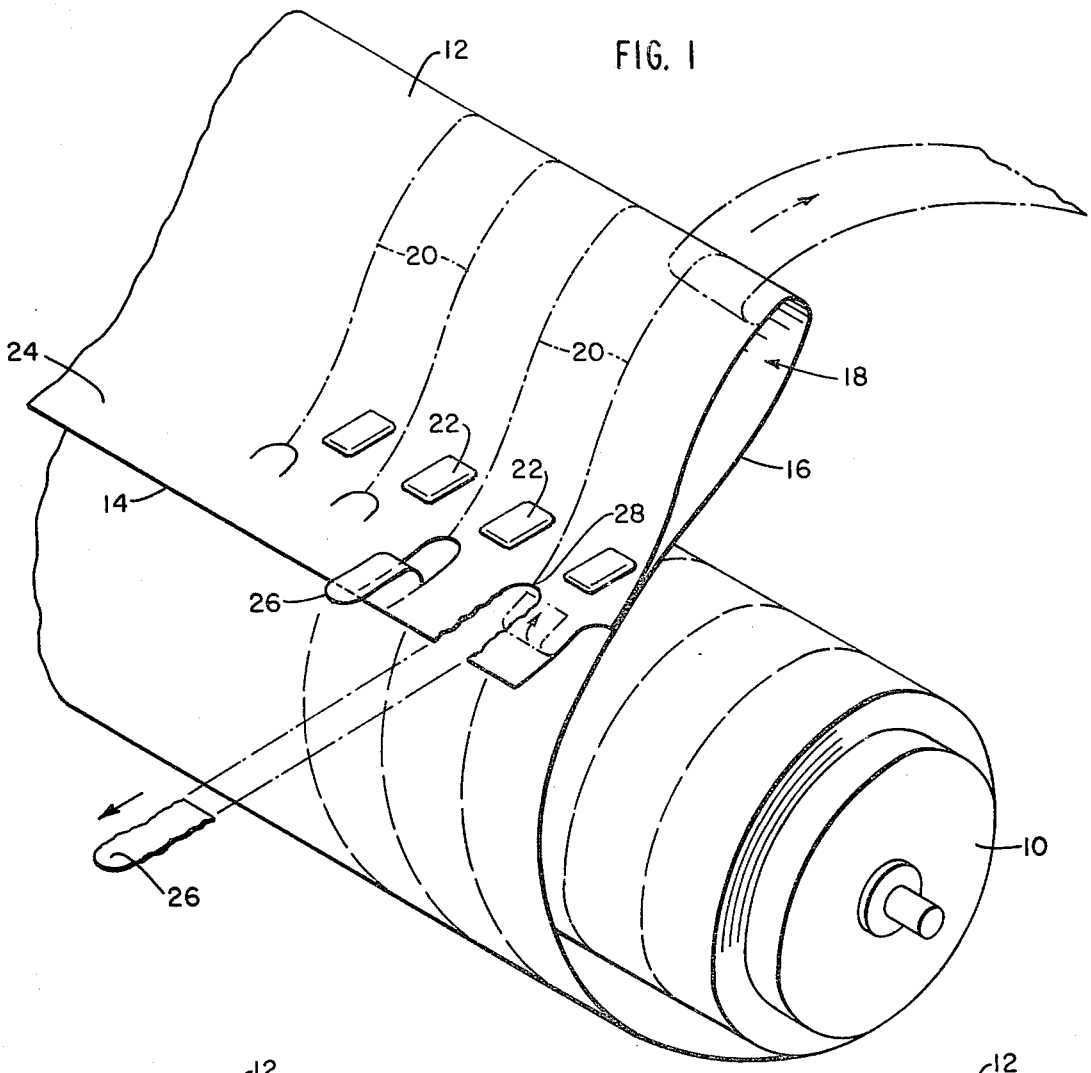
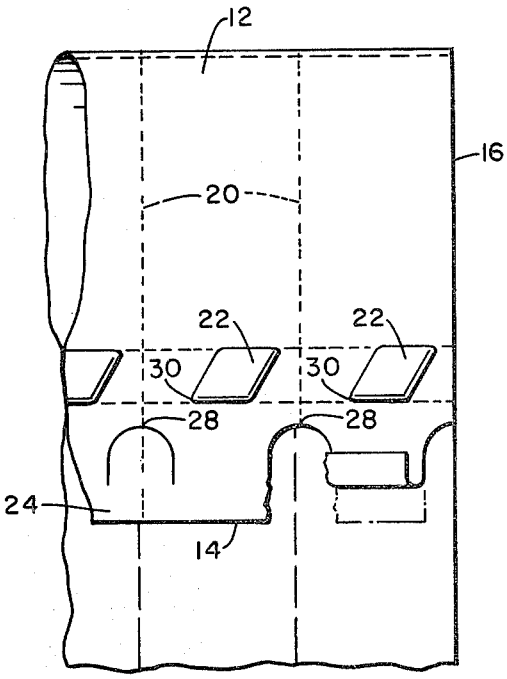
FIG. 2
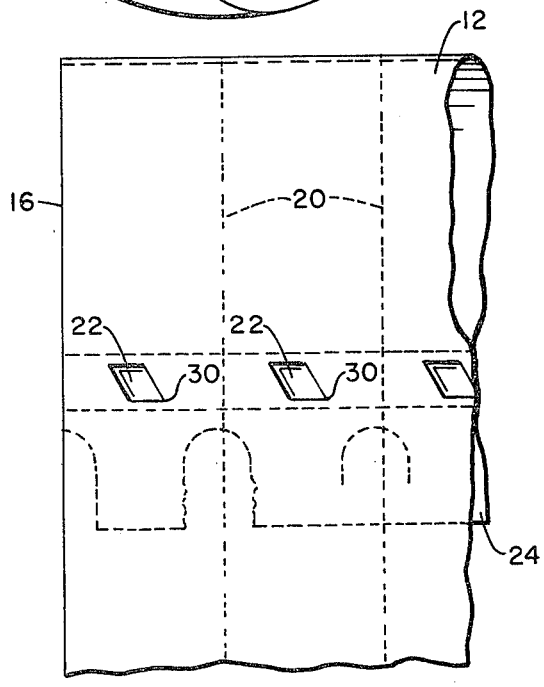
FIG. 3

TEAR STARTING MECHANISM FOR TEAR SHADES

FIELD OF THE INVENTION

This invention relates to window shades and more particularly to shades adapted for width adjustment by the purchaser. Still more particularly it relates to shades employing flexible material which, when scored appropriately, can be torn accurately and easily along the score line so as to provide width adjustment. The invention is addressed to the means for starting the tear at the beginning of a given selected score line.

BACKGROUND OF THE INVENTION

In the art of tear shades, flexible shade material (usually thin polyvinyl chloride) is wound onto a shade roller which is equipped in one of various possible ways to telescope within itself to shorten its length. The shade material is scored from top to bottom of the shade along one margin with spaced parallel score lines usually ½" apart. When a width adjustment is desired, the user starts the material tearing along a selected score line, peels off the unwanted part, adjusts the length of the shade roller, and then mounts the adjusted shade in place.

The problem encountered in many arrangements is that the material tends not to start tearing accurately along a selected score line. It will be understood that the score lines must not be so deep that the shade material will tear easily otherwise there will be a risk that they may tear accidentally in use. For this reason it is preferable to have score lines which are on the shallow side, i.e. only sufficiently deep to provide uniform and accurate tearing. With such tear lines, however, the start of the tear becomes a problem.

In one form of tear shade a v-cut is formed along the bottom edge of the shade with the apex of the v on the tear line. This form has several drawbacks. First, starting the tear is so easy that there is a substantial risk of accidental tearing. Second, the apex of the v must be vey accurately positioned or else a tear will be started elsewhere than on the desired tear line.

Accordingly, an object of the present invention is to provide convenient, sure means for starting the tear, in a tear shade along a selected score line.

BRIEF DESCRIPTION OF THE INVENTION

In the accomplishment of this objective, in a preferred embodiment of the invention, a shade is provided comprising a generally rectangular sheet of flexible material having top, bottom and side margins. Parallel to one side margin are a plurality of spaced parallel score lines, typically ½" apart. The score lines are gauged in relation to the thickness and composition of the material to tear uniformly along the tear line once a tear is started. The bottom margin is folded up to form a pocket with the shade material sealed to itself at spaced points between the score lines in such a way as to leave a substantial flap (typically ¾") free along the margin. The flap is provided with perforations forming pull-tabs which bridge each score line along a line parallel to the bottom margin toward the bottom margin from the line of the seals. The contour of the perforations is such that when the pull-tabs are pulled, they tear out a portion of the shade material along the margin which has a wide base toward the margin terminating at an apex at a score line away from the margin. This provides a concentration of force at the score line when the remaining part of the flap nearest said one said margin is pulled, thereby promoting the start of the tear at the desired location, but without introducing a risk of starting a tear accidentally.

It is a feature of the invention that the contour of the seals also provides an apex pointing toward the nearest perforation inwardly of the seal from said one side margin. This apex also promotes both pulling apart the seal and tearing of the shade material adjacent to the seal, whereby a continuation of the tearing action is facilitated.

BRIEF DESCRIPTION OF THE DRAWINGS

A preferred embodiment of the invention selected for purposes of illustration is shown in the accompanying drawings in which:

FIG. 1 is a fragmentary view in perspective of one end of a roller shade according to the invention.

FIG. 2 is a fragmentary front plan view of a marginal portion of the shade of the invention, and FIG. 3 is a fragmentary rear plan view of a marginal portion of the shade of the invention.

DETAILED DESCRIPTION OF THE INVENTION

The preferred embodiment of the invention herein shown comprises a shade roller 10 which may take the form of any of the available adjustable arrangements. Wound around roller 10 is a length of shade material 12 (typically thin polyvinyl chloride) having a top margin (not shown), a bottom margin 14, one side margin 16, and a second side margin (not shown). The bottom margin 12 is folded upwardly to form a pocket 18 which can be used typically to house a bottom slat (not shown) for the shade. The shade material 12 is scored along a plurality of lines 20 parallel to margin 16 and spaced typically ½ apart. The number of score lines is a matter of choice, often there will be as many as 24. The pocket 18 is formed by sealing the shade material to itself at discrete, spaced diamond-shaped (parallelagram) seal-points 22 positioned along a line parallel to the bottom margin, with one seal-point 22 between each score line 20. The seal-points 22 are also located inwardly of the bottom margin 14 far enough to leave a flap 24 of about ¾" in width. The flap 24 is provided with spaced perforations forming pull-tabs 26 bridging each score line 20 along a line about ¼" toward bottom margin 14 from the line of seal-points 22. The perforations are contoured so that when the pull-tabs 26 are pulled toward margin 14 so as to tear the shade material 12, this leaves an opening which is wide in the direction of margin 14 and which narrows toward an apex 28 at the associated score line 20. The shape of the perforation can be semicircular as shown or angular. The important point is that, by culminating in an apex at the score line (even the mild apex of an arc), there is a concentration of stress at the score line when the remaining portion of flap 24 toward margin 16 is pulled. This promotes the start of the tear at the correct point. In addition, the diamond-shaped (parallelagram) seal points 22, have an acute angle point at 30 which extends forward the nearest inward pull-tab 26. Thus, when the portion of flap 24 nearest margin 16 is pulled (after removal of pull-tab 26), and a tear along score line 20 has started, the next thing that happens is that a concentration of stress appears at the acute angle point 30. This promotes either a separation of the seal or a localized tearing of the shade material, either of which is useful because the object at this point is to reduce resistance to the tearing of the shade material along the score line 20.

It is important that the perforations which form pull-tabs 20 are positioned far enough from the line of seal-points 22 so that full stress will be applied at apex 28 without appreciable resistance from seal points 26. This concentration is accomplished by arranging the perforations about ¼" toward bottom margin 14 from the line of seal points 22. In this way a clean tear along score lines 20 is assured.

The perforations are also contoured so that the pull-tabs 20 have substantially parallel sides extending toward margin 14. In this way pulling the pull-tabs 20 concentrates stress at the bases of the sides of pull-tabs 20 so as to promote tearing out of the pull tabs.

The material from which the shade 12 is made need not be vinyl. Any material (nylon, mylar, polyester, polyethylene, etc.) which is capable of being torn cleanly along a selected score line can be used. Also the score lines need not be straight as shown, but can be curved, waved or otherwise shaped. Heat sealing need not be used. Adhesives can be suitable. The dimensions of ¾" for flap 24 and ½" for pull-tabs 26 are not specifically required as long as the functional requirements of the successive concentration of stress are met.

I claim:

1. A tear shade comprising a sheet of flexible shade material having top, bottom and side margins, a plurality of spaced score lines in said material extending from the bottom to the top margins and parallel to one side margin for weakening said material to permit hand tearing of said material along any selected one of said score lines whereby to reduce the width of said shade to a selected degree, the bottom margin folded upwardly to form a pocket along the bottom of the shade, means sealing the shade material of the pocket to itself between the spaced score lines on a line parallel to the bottom margin and substantially inwardly of the bottom margin to form a free flap of said material, spaced perforations in said flap along a line parallel to the bottom margin forming pull-tabs bridging each score line between the bottom margin and the line of said sealing means, the configuration of said perforations providing said tabs with a wide base nearest to said bottom margin narrowing to an apex at the respective score lines whereby pulling said tabs toward said bottom margin to tear said material leaves an opening along said bottom margin which terminates at an apex located at a score line thereby permitting the remaining part of said flap on the side of said opening toward said one side margin of the shade to be pulled so as to start tearing the shade material along a selected score line.

2. The tear shade defined in claim 1 further characterized by said sealing means comprising a heat seal.

3. The tear shade defined in claim 1 further characterized by said sealing means terminating at an apex pointing toward the nearest perforation to said sealing means away from said one side margin whereby tearing of said material and release of said seal are promoted when the shade material is torn along the selected score line.

4. The tear shade defined in claim 3 further characterized by the line of said perforations arranged with respect to the line of said sealing means to concentrate stress at the apex of said perforations before substantial stress appears at the apex of said sealing means when said remaining part of said flap is pulled.

5. A tear shade made of thin flexible material in which an area of the shade is provided with means for reducing the width of the shade including score lines along which the shade can be torn cleanly characterized by means for starting a tear at a given margin of said shade along a given score line which terminates at said margin comprising a perforation bridging said score line, the contour of said perforation forming an apex pointing away from said margin and said apex terminating at said score line, whereby pulling said shade material apart at said score line, concentrates stress at said apex.

6. The tear shade defined in claim 5 further characterized by said perforation further forming a pull-tab bridging said score line and having sides substantially parallel to said score line whereby pulling said pull-tab concentrates stress at the base of the sides thereto thereby promoting tearing of said material from the pull-tab toward said margin and thereby freeing said margin for subsequent pulling to start a tear at said apex along the score line.

* * * * *